United States Patent [19]

Rovin et al.

[11] 4,248,414

[45] Feb. 3, 1981

[54] PANEL FOLDING MACHINE AND METHOD

[75] Inventors: Herman Rovin, Norwalk; Theodore Opuszenski, Darien; Joseph Pellicano, Greenwich, all of Conn.

[73] Assignee: Automatech Industries, Inc., Bridgeport, Conn.

[21] Appl. No.: 938,335

[22] Filed: Aug. 31, 1978

[51] Int. Cl.[3] ..... B65H 45/00

[52] U.S. Cl. ..... 493/416; 242/74.1; 242/67.2; 493/462; 493/937

[58] Field of Search ..... 271/61 R, 62; 93/84 R, 93/84 TW, 77 R, 94 R; 242/74.1, 67.1–67.3 F

[56] References Cited

U.S. PATENT DOCUMENTS

| | | | |
|---|---|---|---|
| 3,467,370 | 9/1969 | Grantham | 270/85 |
| 3,711,086 | 1/1973 | Weist | 270/61 R |
| 3,783,750 | 1/1974 | Heimeijer | 242/67.1 R |
| 4,093,205 | 6/1978 | Kober | 270/66 |
| 4,136,860 | 1/1979 | Shocklett | 270/61 R |

FOREIGN PATENT DOCUMENTS

| | | | |
|---|---|---|---|
| 1211123 | 2/1966 | Fed. Rep. of Germany | 270/61 R |

*Primary Examiner*—Edgar S. Burr

*Assistant Examiner*—A. Heinz

*Attorney, Agent, or Firm*—Mandeville and Schweitzer

[57] ABSTRACT

The disclosure relates to a panel folding machine and method, particularly for large panels. The panel is gripped at opposite leading corners and wound up by spaced rotating drums engaging opposite side edges of the panel. The drums are axially withdrawn, dropping the once-wound panel onto a lateral conveyor, where the panel, initially wound in a somewhat cylindrical form, assumes a flat folded condition. The once-wound panel is conveyed laterally until the leading lateral edge is engaged and gripped by a second stage winding drum, rotatable at right angles to the first drum. The panel is then wound in a second stage, in a generally cylindrical configuration. The second stage winding drum is retractable, and is withdrawn after the second stage winding operation, permitting the twice folded panel to drop onto a support conveyor. While on the support conveyor, the panel is flattened, to form a neat, rectangular product of uniform dimensions, which is then taken away for packaging. The neatness and uniformity of the folding operations makes the equipment easily adaptable for automatic packaging of the folded product.

7 Claims, 14 Drawing Figures

PANEL FOLDING MACHINE AND METHOD

BACKGROUND AND SUMMARY OF THE INVENTION

In the manufacture and marketing of relatively large panel sections of fabric, such as sheets and curtains, for example, folding and packaging of the panels has long represented a difficult and time consuming operation. To begin with, the panels can be quite large and therefore somewhat unwieldy to handle. Additionally, to accommodate automatic packaging operations, it is important that the folded panels be of uniform dimensions, capable of being handled properly by the packaging machinery and capable of fitting properly within the intended packages. Even further, it is important, in at least some cases, to fold the panels in a manner such that particular, desired portions of the panel are visible after folding. For example, in a quality product, it may be desirable to have a hemmed edge visible in a center area of the folded article, where it is readily visible to the purchaser.

A basic objective of the present invention is to substantially automate the folding of flat, panel-like articles, such as sheets, curtains, bedspreads, blankets, tablecloths, and the like, in such manner as to enable the folding to be completed with a minimum of operator time and attention and to provide a folded article which is superior in quality and uniformity to that which can be achieved manually.

Pursuant to the invention, panels for folding are delivered either in flat condition (e.g., laid up on a pallet) or draped over a bar, for example. The machine operator(s) pick up the two front corners of the panel and engage the same in rotary winding drums. The panel is wound up on the drums, which are of predetermined diameter to provide a predetermined folded width. When the panel is completely wound on the drums, the drums are stopped and withdrawn, dropping the panel onto a lateral transfer conveyor. When released from the drums and supported on a flat conveyor, the panel assumes or is caused to assume a flat folded condition. The panel is then advanced laterally and guided into a second stage winding drum. The second stage drum grips the lateral edge of the panel and winds the panel to a predetermined diameter. Thereafter, the second stage winding drum is withdrawn and the now twice-wound panel is squeezed to flat form, providing a compact, uniformly folded flat article, which is conveyed away for packaging.

Pursuant to one aspect of the invention, after each of the first and second winding stages, the generally cylindrically wound article is released and converted to flat condition. By winding in cylindrical form, the winding operation may be carried out at relatively high speed. Yet, after converting to flat form, the panel is substantially in the same form as if it had been flat folded in the first instance.

To advantage, the rotary motion in both the first and second winding stages is adjustably controllable, as by means of a suitable increment counter, for example. Accordingly, the winding operations may be stopped in any predetermined final rotary position, so that the trailing edges of the panel may be positioned in a desirable location from the standpoint of the aesthetics of the finished package. Additionally, throughout the process, the panel is smoothed and aligned and otherwise controlled to provide a folded article which is higly attractive in appearance and capable of commanding an optimum return in the marketplace, while at the same time affording significant savings in labor costs.

For a more complete understanding of the above and other features and advantages of the invention, reference should be made to the following detailed description of a preferred embodiment and to the accompanying drawings.

DESCRIPTION OF A PREFERRED EMBODIMENT OF THE INVENTION

Figure 1:
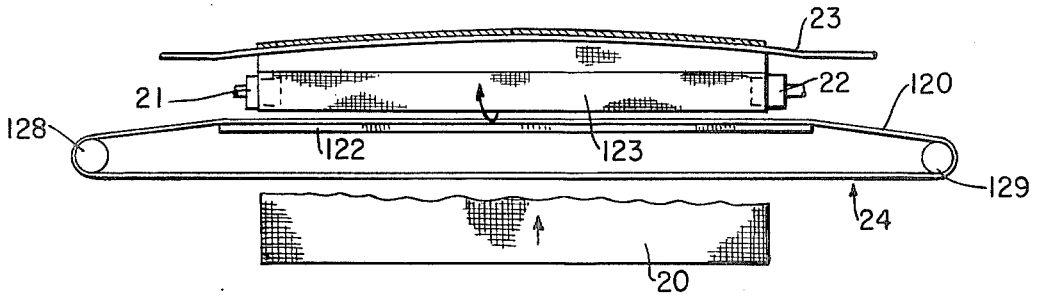
FIG. 1 is a simplified, schematic perspective view illustrating the manner in which a large fabric panel is engaged and processed in a first folding stage, according to the invention.

Referring now to the drawings, and initially to FIGS. 1–5 thereof, the reference numeral 20 designates generally a large panel of limp material, typically a fabric panel comprising a bed sheet, curtain, bedspread, blanket, tablecloth, or the like. By way of a highly simplified and generalized summary of the procedure of the invention, the panel 20 is engaged by the opposite corners of its leading edge, by means of spaced apart winding drums 21, 22. While being wound by the drums 21, 22 into a generally cylindrical form, the fabric is drawn over a bow-shaped guide 23, which flattens and smooths the fabric in advance of the winding operation. By means to be described, the side edges of the panel are accurately aligned and positioned at a location slightly in advance of the winding drums.

Figure 2:
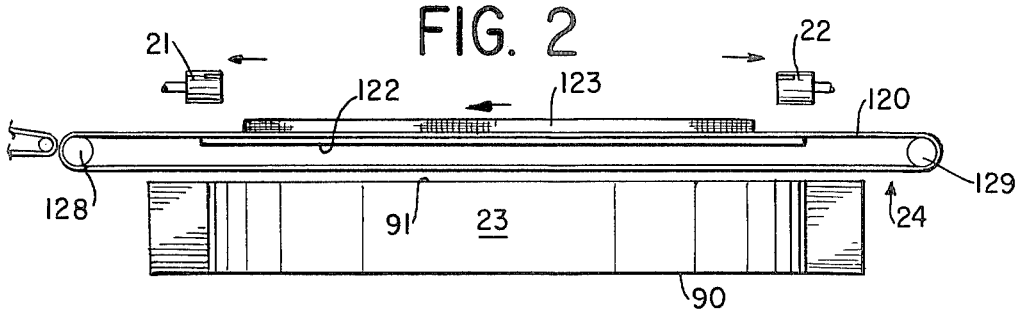
FIG. 2 is a simplified, schematic representation illustrating a fabric panel, already folded in a first stage, being transferred to a second stage for folding.

After first stage winding of the panel 20 has been completed, the winding drums 21, 22 are withdrawn axially, as shown in FIG. 2, allowing the wound up panel 20 to fall upon an underlying conveyor 24. By means of an impact presser 25, which momentarily descends upon the fabric, the wound panel is held while the drums are withdrawn and also is caused to assume a flat form. Thereafter, the conveyor 24 is operated to displace the once folded panel laterally, engaging its lateral leading edge 25 in the jaws of a second stage winding drum 26. The second stage winding drum is than actuated, winding up the first folded panel along a second axis, at right angles to the first winding axis, substantially as reflected in FIGS. 3 and 4. When the second stage winding is complete, the elements forming the second stage winding drum 26 are retracted, and the twice wound panel is flattened between opposed arms 27, 28, to assume a flat, twice folded condition.

As will be described in greater detail hereinafter, the twice folded panel is of a neat, rectangular configuration, highly uniform in size and shape, providing for efficient subsequent packaging operations. In addition, the method and apparatus of the invention are susceptible of convenient control, such that the exposed, trailing edges of the panel in both the first and second stages of folding are desirably positioned in the finished article. The arrangement is such that the final packaged article may have the most desirable and advantageous appearance from the standpoint of location of hems and edges, whether this involves giving prominence to the hems and edges, as in the case of high quality articles, or providing for subdued prominence of these features, as may be desired for lower cost, lower quality merchandise.

In the specific apparatus illustrated in FIGS. 6–12 herein, there is a static machine frame, not specifically described, which includes a pair of transversely extending guide and support rods 30, 31 (FIG. 10) on which are adjustably mounted a pair of winding carriages, generally designated by the reference numerals 32, 33 (FIGS. *6b, 6c*). The winding carriages 32, 33 support the beforementioned first stage winding drums 21, 22, and are normally set in fixed positions for the processing of panels of a given width, but may be adjusted toward and away from an imaginary center line of the first winding stage, in order to accommodate panels of different overall width.

With reference particularly to FIG. *6b*, the winding carriage 32 includes a pair of supporting plates 34, 35 which are slideably mounted on the guide rods 30, 31. A drive shaft 36, which extends the full width of the first winding stage and is of square or splined configuration, is rotatably supported in a bearing 37 on the carriage. The drive shaft 36 is engaged to be driven by a suitable power source (not shown) as will be understood.

Carried by the winding carriage 32, but rotatably driven by the shaft 36, is a power sprocket 38, which is connected by a chain or positive drive timing belt 39 to a similar sprocket 40 carried by a winding shaft 41. The winding shaft 41 is journaled in bearings 42 in the carriage and extends laterally to support and engage the left side winding drum 21. The winding shaft 41 is rotatable in and movable with a mounting plate 43, which in turn is mounted on the rod 44 of a fluid actuator 45 supported on the winding carriage 32. For a winding operation, the actuator rod 44 is extended to a limit position, in which the winding drum 21 is aligned with a leading corner of the fabric panel 20. At the end of the winding operation, the actuator 45 is retracted, withdrawing the carrier plate 43 laterally, along with the winding drum and its related mechanisms. The winding shaft 41 has a slideable driving relationship with the sprocket 40 to accommodate the lateral movements of the winding drum 21.

As reflected in FIGS. 7–10, the winding drum 21 (which is essentially duplicated on the opposite side by the winding drum 22) is shown to comprise fixed and movable drum sections 46, 47. The fixed drum section 46 is mounted on the winding shaft 41 and is of generally semi-cylindrical configuration. The movable drum, also of generally semi-cylindrical configuration, is pivoted to the fixed element at one side, by means of a pin 48. A spring 49 connects the two drum halves 46, 47, tending to bring the sections to a closed or contracted condition. A cam element 50 is carried by the fixed drum section 46 and is rotatable against a follower plate 51 on the movable drum section to pivot the latter to an open or expanded position. The basic peripheral dimension of the winding drums is variable, within limits, by for example utilizing follower plates 51 of various thicknesses.

In the illustrated arrangement, the fixed drum section 46 includes a recessed portion 52, forming a flat surface 53, and this is partially covered by means of an arcuate plate 54. A clamping arm 55 is pivoted at 56 in the fixed section of the winding drum and is arranged, when closed, to clamp the leading corner area 57 of the fabric against the flat surface of the winding drum.

Control of the opening and closing movements of the winding drum, and clamping and releasing movements of the clamping arm 55, is effected by rotary movement of a control disc 57. The disc carries a pair of drive pins 58, 59 (FIG. 8) which are received respectively in slotted control arms 60, 61. When the disc 57 is rotated in a clockwise direction, as viewed in FIG. 8, the arm 61 pivots counterclockwise, rotating the pivot shaft 56 and moving the fabric clamping arm 55 to a released position. At the same time, the control arm 60 is pivoted in a counterclockwise direction, rotating the shaft 62 and the cam 50, to permit closing or contracting movement of the pivoted drum section 47. In this condition, the winding drum is ready to release a previously wound panel of fabric and to receive for clamping a new panel. When the new panel is in position, the disc 57 is rotated in a counterclockwise direction, swinging the clamping arm 55 down against the fabric and rotating the cam 50 to expand the winding drum 21 to its normal working diameter.

The desired rotary motion of the control disc 57 is effected by means of a sleeve 63 fixed thereto and having an elongated helical slot 64 therein. The slot 64 receives a cam pin 65, which extends through a control collar 66 and into a longitudinally disposed slot or recess 67 in the winding shaft 41. Thus, the cam pin 65 and control collar 66 are rotatable with the winding shaft 41, while being slideable longitudinally with respect thereto, confined by the longitudinal guide slot 67.

As reflected in FIG. *6b*, extending movement of the control collar 66 (to the right in FIG. *6b*), with the cam pin 65 confined to the longitudinal slot 67, will cause rotation of the sleeve 63, as the pin 65 advances in the helical slot 64 therein. This will result in clockwise rotation of the disc 57, as viewed in FIG. 8. Opposite or clockwise rotation of the disc 57 results from retracting motion of the control collar 56, as will be understood.

To effect controlled advancing and retracting movements of the control collar, a yoke assembly is provided, consisting of spaced yoke bars 68, 69, pivoted at 70 on a bracket 71 extending from the carrier plate 43. At their upper ends, the yoke bars 68, 69 are connected by a rod 72 engaging, through a block 73, the operating rod 74 of a fluid actuator 75. The yoke bars 68, 69 carry opposed pins 76, 77 which are received in an annular groove 78 in the control collar at diametrically opposite points, so as to engage the control collar in any rotary position thereof. Opening and closing movements of the winding drum, and clamping and releasing of the fabric therein, are thus controlled by energization of the fluid actuator 75.

When winding operations are proceeding, it is desirable to maintain a minimum degree of winding tension on the fabric being wound on the drum. To this end, each winding drum has associated with it a pressure plate 80, including a relatively friction free surfacing material. The pressure plate is mounted on an arm 81 pivoted on a triangular lever plate 82. At one corner, the lever plate 82 is anchored by a pivot pin 83 to a bracket 84 on the carrier plate 43. At another corner, the lever plate 82 is engaged by a pin 85 with the operating member 86 of a fluid actuator 87 mounted on the carrier plate. During winding operations, the actuator 87 is energized to retract, pivoting the lever 82 in a direction to apply a controlled pressure to the fabric being wound on the drum. In order to release a wound fabric panel, the actuator 87 is energized in the opposite direction, to retract the pressure plate.

Figure 7:
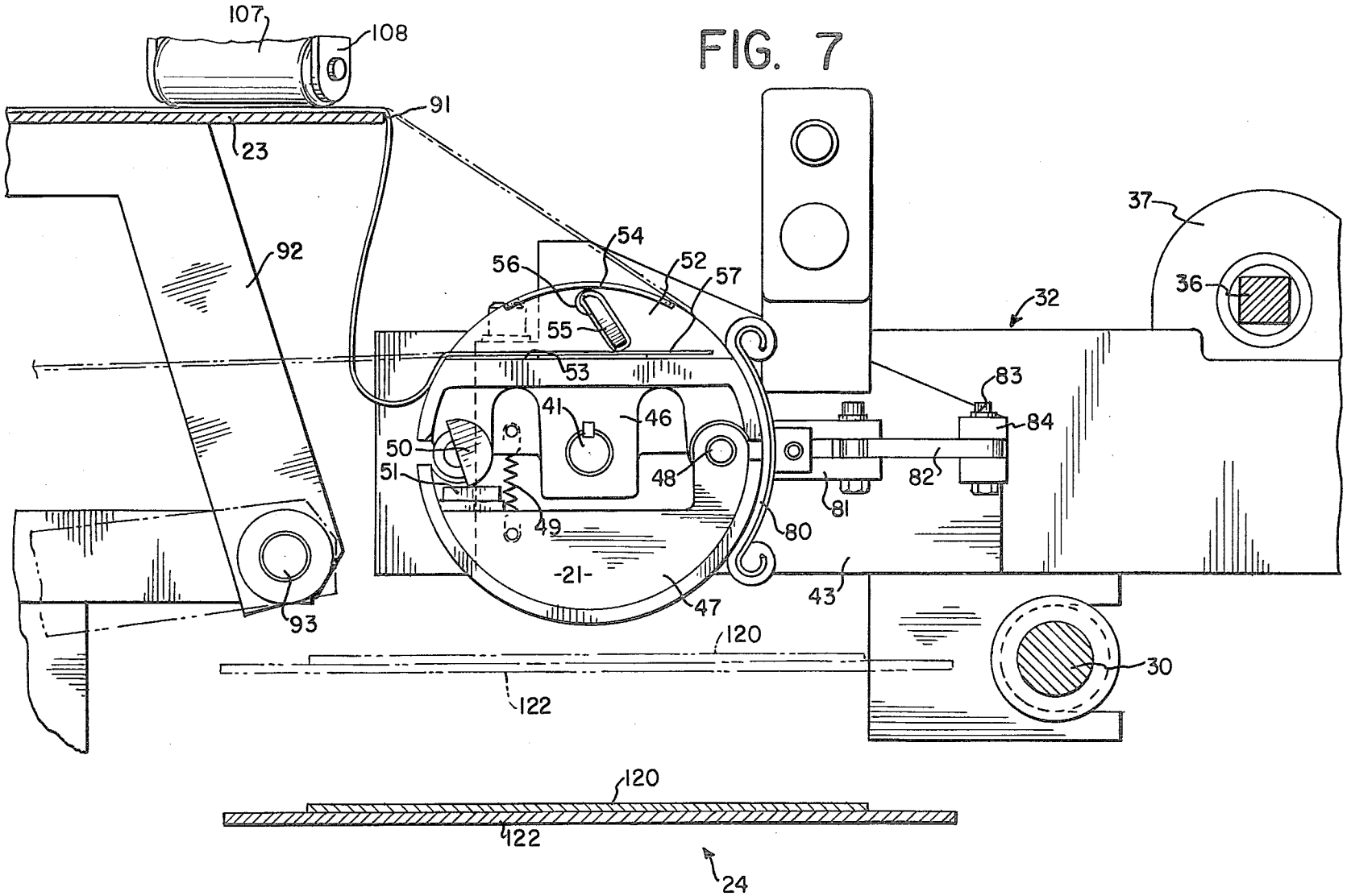
FIGS. 7 and 8 are enlarged, fragmentary cross sectional views as taken generally on lines 7—7, 8—8 respectively of FIG. 6*b*.
Figure 8:
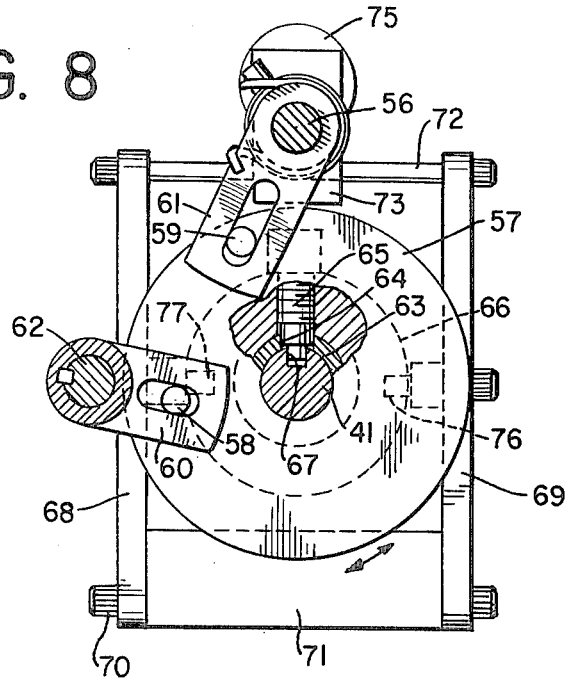

In the winding of a large panel of limp material, it is important to provide for the material to be in smooth condition as it approaches the winding station. For this purpose, a bowed plate 23 (FIGS. 1, 7, 10) is arranged to extend for the full effective width of the fabric, between the supply source and the winding station. The supply source, typically, is a stack of panels located on a pallet or rack at the front of the machine, at a level below the axis of the winding drums 21, 22. As reflected in FIG. 1, in the operational conditions of the equipment, a fabric panel 20 extends upward from the supply, over the front edge 90 of the bowed plate 23, then over the back edge 91 thereof, and then generally downward toward the winding drum, as reflected in broken lines in FIG. 7. In this respect, the bowed plate 23 is a relatively wide sheet metal section which, when oriented generally horizontally as reflected in FIGS. 1 and 7, provides two discrete bowed edges for smoothing of the fabric in advance of the winding drums, and also provides a flat surface for the fabric to pass over to facilitate inspection.

When the bowed plate 23 is in its operative position, it is located in front of and somewhat above the level of the winding drums. Since this configuration would tend to interfere with the loading of a new panel into the winding drums, provision is made for retracting the bowed plate during the loading phase. To this end, the bowed plate is mounted on generally L-shaped arms 92 (FIGS. 7, 10), which are pivoted at 93 on the stationary machine frame. A fluid actuator 94 is connected to the supporting frame structure of the bowed plate. When extended, the actuator 94 pivots the bowed plate 23 into its raised or operative position, as shown in FIGS. 1 and 7. When retracted, the plate is pivoted forward and downward, to the position shown in FIG. 10, to provide easy access to the winding drums 21, 22 for loading.

In addition to smoothing out of the fabric by means of the bowed plate 23, provisions are made for aligning the side edges of the panel with a predetermined reference. To this end, a photocell detector unit 100 is provided in association with one side edge of the panel 20. In the illustrated instance, this being the right-hand edge 101 (FIG. 6*c*). The photocell detector includes a pair of laterally spaced photocell elements 102, 103, which are mounted by means of a bracket 104 at the side of the bowed spreader plate 23. The photocell elements 102, 103 are arranged to scan the edge of the fabric as it approaches the right-hand winding drum 22. When both sensors can "see" the fabric, the edge 101 is too far to the right, and a leftward correction is indicated. When neither sensor sees the fabric, the edge 101 is too far to the left and an opposite correction is indicated. As long as the edge is between the sensors, acceptable alignment is indicated, and no correction is required.

Figure 9:
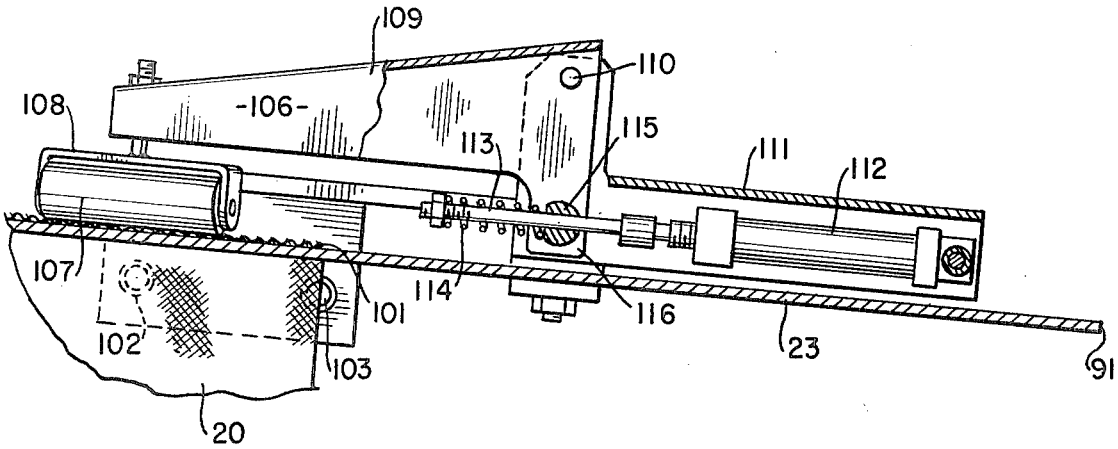
FIGS. 9 and 10 are enlarged, cross sectional views as taken generally on lines 9—9, 10—10 respectively of FIG. 6*c*.
Figure 10:
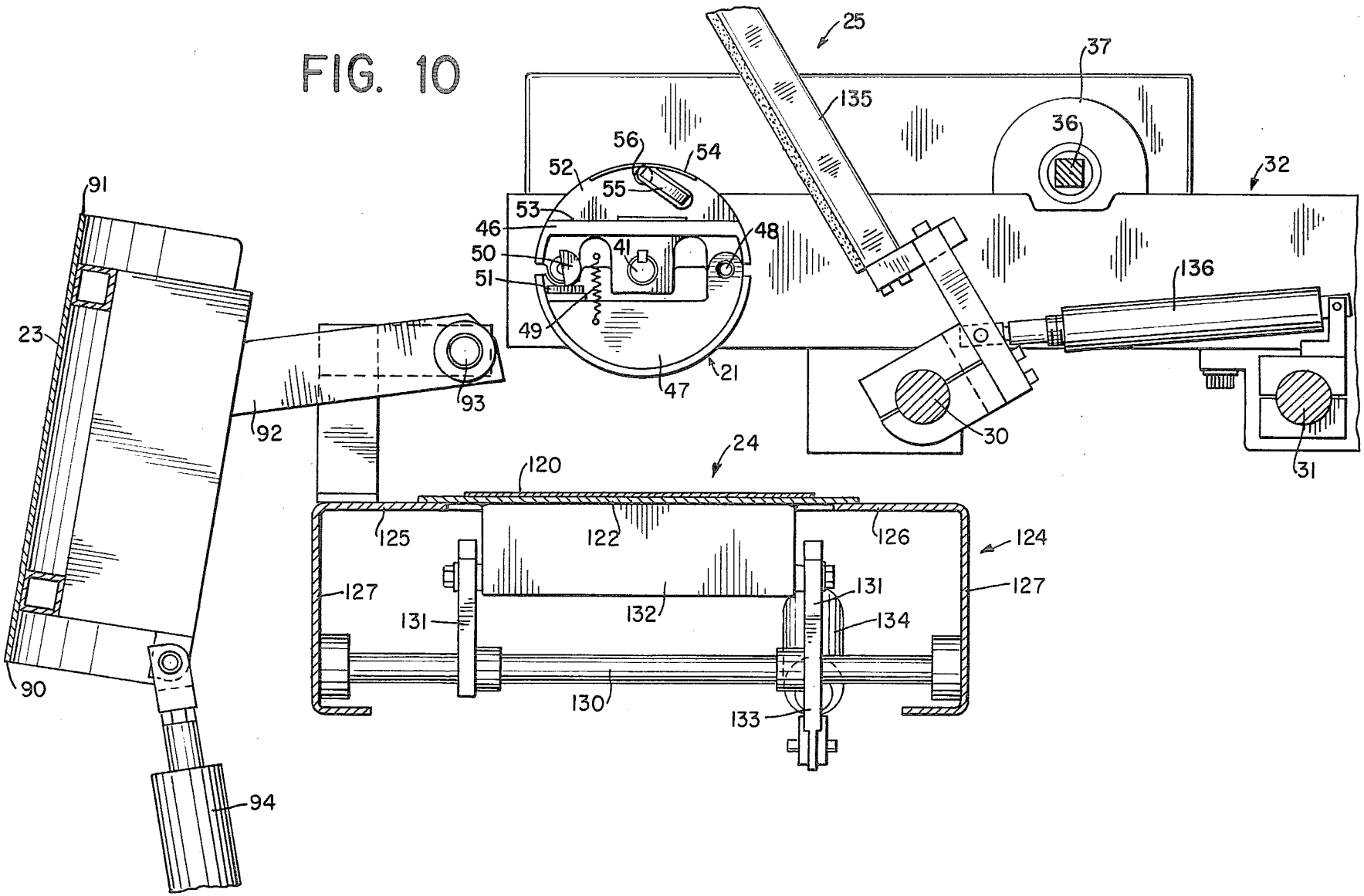

In order to bring out correction, when necessary, there is provided at each side, adjacent the edge margin of the fabric panel 20, an adjusting mechanism 105, 106 corresponding to the mechanism 106 shown in FIG. 9. In the illustrated arrangement, the adjusting mechanism includes a pressure roller 107 mounted for free rotation and disposed at an angle of, say, about 60° to the side edge of the fabric. The pressure roller 107 is positioned directly over the surface of the bowed plate 23, somewhat inward of the edge extremity of the fabric. The orientation of the pressure roller is such that, when it is pressed against the fabric, and the fabric is being advanced longitudinally toward the winding drums, the angular component of motion of the roller will urge the fabric in the direction of the nearest side edge. In other words, the right side adjusting mechanism 106 will urge the fabric toward the right, while the left-hand mechanism 105 will urge it to the left.

As shown in FIG. 9, the roller 107 is carried by a yoke 108 mounted on a lever arm 109. The arm 109 is pivoted at 110 to a mounting bracket 111, which is fixed to the bowed plate 23. A fluid actuator 112 is anchored in the bracket 111 and has an operating rod 113 associated through a compressible spring 114 and slide bearing 115 with an arm 116 of the lever 109. When the actuator 112 is energized to retract, the pressure roller 107 is urged downward against the surface of the fabric, exerting an effective lateral component on the fabric to adjust the location of the edge 101. When the actuator 112 is deenergized, pressure is released from the roller 107, which becomes ineffectual. If desired, the roller may be physically raised from the surface of the fabric.

In the illustrated arrangement, the control of the photocell sensors 101, 102 is such that, if the fabric wanders sufficiently far to the left to uncover both sensors, the right-hand adjusting mechanism 106 is actuated, to bring the fabric edge 101 back to the right. Once the sensor 102 has been covered, the right-hand adjusting mechanism 106 is deactuated, and the apparatus will continue to operate with neither mechanism being actuated, as long as the edge 101 remains somewhere between the sensors 101 and 102.

During the winding of a panel on the drums 21, 22, the wound-up portion of the fabric is unsupported over the span between the spaced winding drums. As a result, the center portion of the fabric may tend to sag slightly. In part, this is offset by directing the fabric over the rear edge 91 of the bowed plate 23, from a level above the winding drums, such that the slight back tension on the fabric tends, if anything, to lift the center area of the wound-up fabric. In addition, it may be desirable to provide some measure of support of the wound-up fabric from below. To this end, the apparatus of the invention includes an upwardly displaceable conveyor belt 120, which is liftable by an elevator plate 122 to a position just slightly below the wound-up portion 123 (FIG. 1) of a fabric panel. If the center portion of the fabric tends to sag excessively during the wind up operation, the center portion thereof will touch the surface of the elevated conveyor belt 120 and be partially supported thereby, at least sufficiently to prevent undesirable distortion of the fabric. Once the winding operation has been completed, the elevator plate 122 is lowered, to the position shown in FIG. 2, enabling the wound-up fabric panel 123 (FIG. 2) to be released and dropped upon the now lowered conveyor 120 for lateral conveyance to a second stage winding operation, as will be described.

In the illustrated equipment, the conveyor belt 120 is supported by a frame structure 124 (FIG. 10) which includes the elevator plate 122. The frame structure includes opposed support flanges 125, 126 extending inwardly from integral, depending side flanges 127. The support flanges 125, 126 provide a reference plane for the lowered elevator plate 122, and the side plates 127 serve to mount the various guiding and driving mechanisms for the conveyor belt, as will be understood. Included in the driving and support mechanism for the conveyor are a pair of spaced drums 128, 129 spaced beyond either end of the elevator plate 122. The axes of the conveyor supporting drums may remain stationary, while the elevator plate 122 is raised and lowered, with appropriate provision being made to maintain conveyor belt tension reasonably constant.

Raising and lowering of the elevator plate may be accomplished by a simple parallelogram-type mechanism, including a pair of spaced shafts 130 (FIG. 10) supported at opposite ends in the frame structure 124. A pair of spaced lifting arms 131 is fixed to each of the shafts 130 and connected to the understructure 132 of the elevator plate 122. One of the arms 131 has an extension 133 which is connected to a fluid actuator 134. When the actuator is extended, all of the arms 131 are simultaneously pivoted from angularly disposed positions to relatively vertical positions, raising the elevator plate 122 to its support position illustrated in FIG. 1 of the drawings. At this point in the operating sequence, the conveyor belt 120 is not in motion, and it merely serves in its elevated configuration to provide momentary support for the winding fabric panel 123. Upon completion of the winding operation, the actuator 134 is deenergized (or reversely energized), lowering the elevator plate and putting the conveyor 120 in condition for transfer motion.

Upon completion of a first stage winding operation, wherein a panel is wound on the winding drums 21, 22, a clamping bar 135 (FIG. 10) is actuated to descend upon the center portion of the wound fabric and both flatten it and momentarily clamp it in position. The clamping bar 135 may be pivoted on the frame rod 30 and operated by means of a fluid actuator 136. As soon as the control circuitry signals the end of a winding operation, the actuator 136 is energized to extend, lowering the clamping bar onto the wound fabric, while the elevator plate 122 is still in its lifted position. Immediately thereafter, the respective winding drums 21, 22 are retracted by appropriate energizing of the respective fluid actuators 45 at each side. Simultaneously or slightly in advance thereof, the cylinders 75 have been retracted to unclamp the fabric panel and also to slightly reduce the diameter of the winding drums to accommodate withdrawal. While the drums are being withdrawn axially from the wound fabric, the clamping bar 135 holds the fabric in position, permitting it to drop free of the winding drums at each end and to be supported fully by the endless conveyor 120. Immediately thereafter, the clamping bar 135 may be retracted, and the elevator plate 122 lowered to its normal position.

Figure 3:
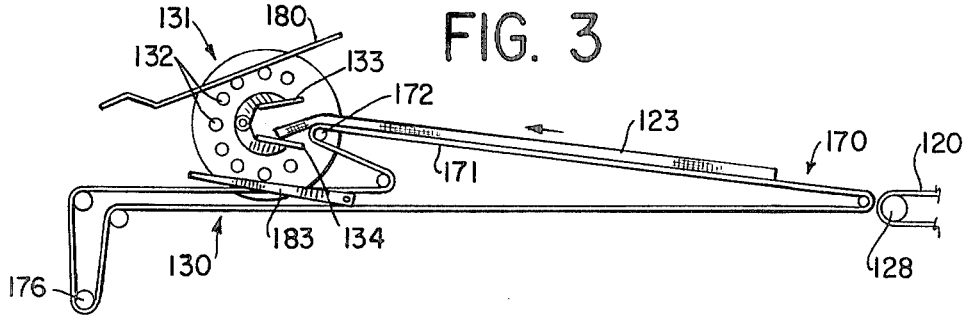
FIGS. 3 and 4 are simplified, schematic representations of a second stage folding operation.

After the elevator plate 122 has been lowered, the conveyor 122 may be set into motion, advancing the once-wound fabric panel 123 to the left, as shown in FIG. 3, toward a second stage winding station, generally designated by the numeral 130.

Figure 6A:
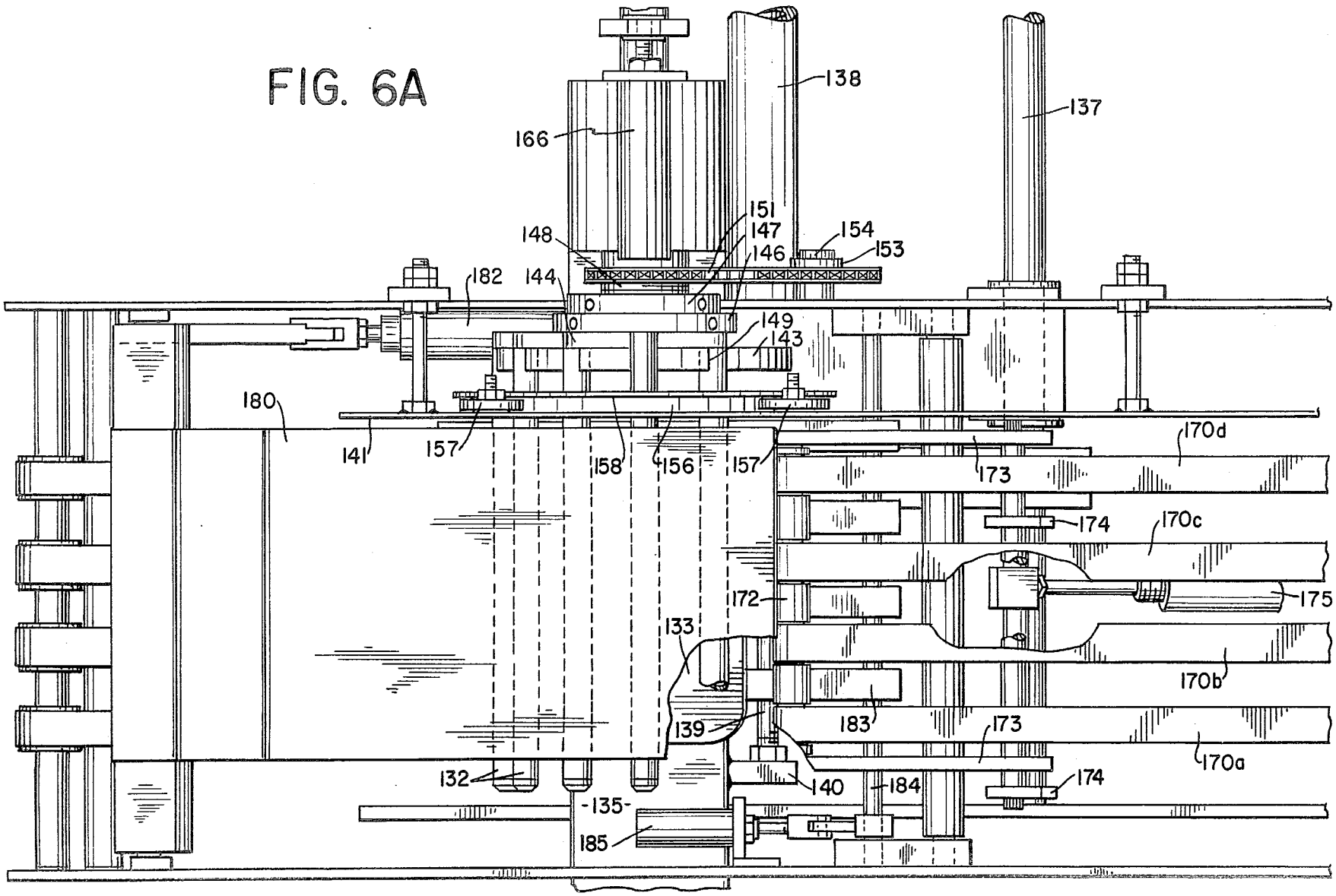
FIGS. 6*a*, 6*b* and 6*c*, collectively, constitute a top plan view of a panel folding apparatus constructed in accordance with the principles of the invention, with parts broken away in certain areas to illustrate details of construction.
Figure 6B:
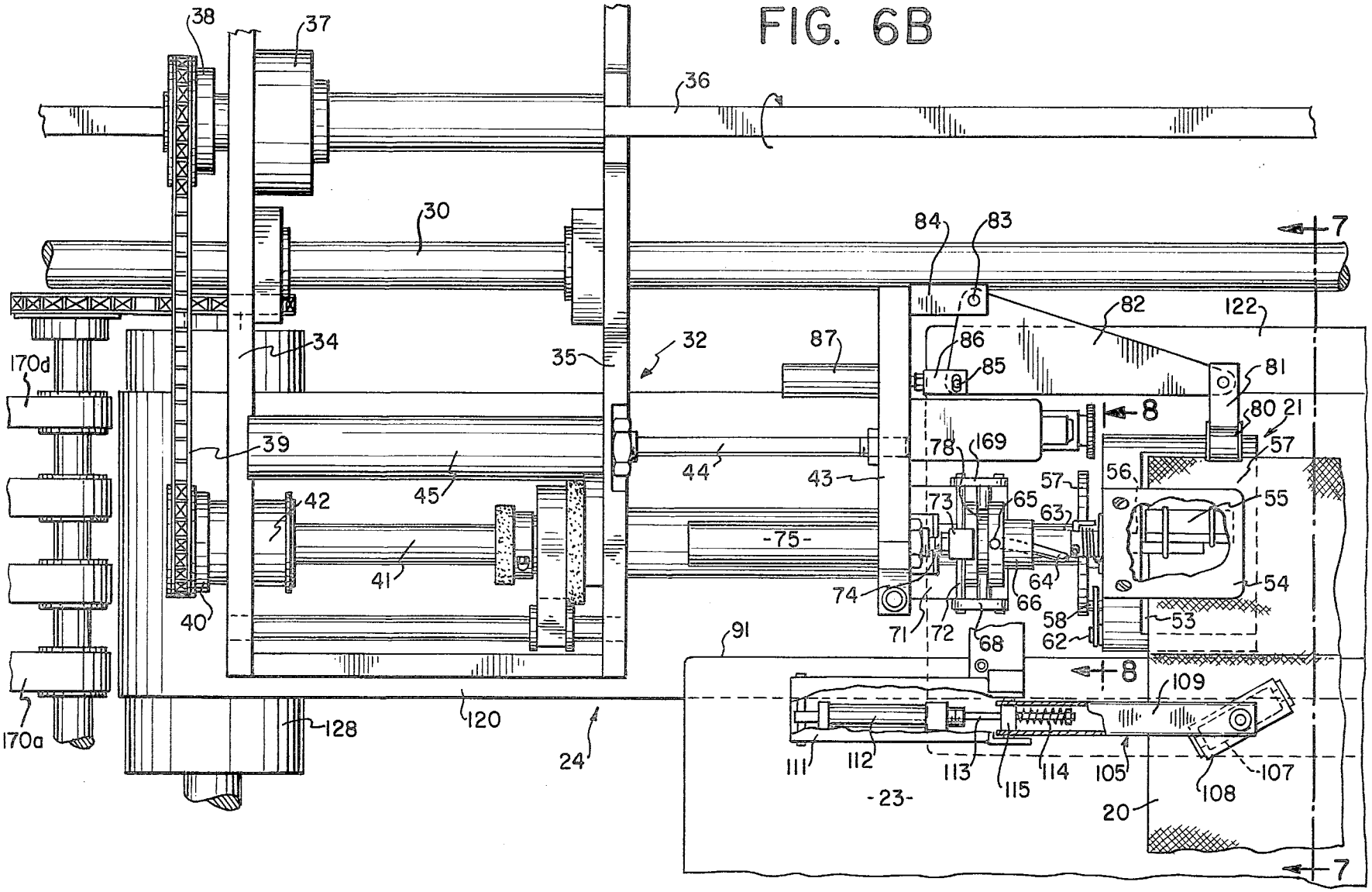
Figure 6C:
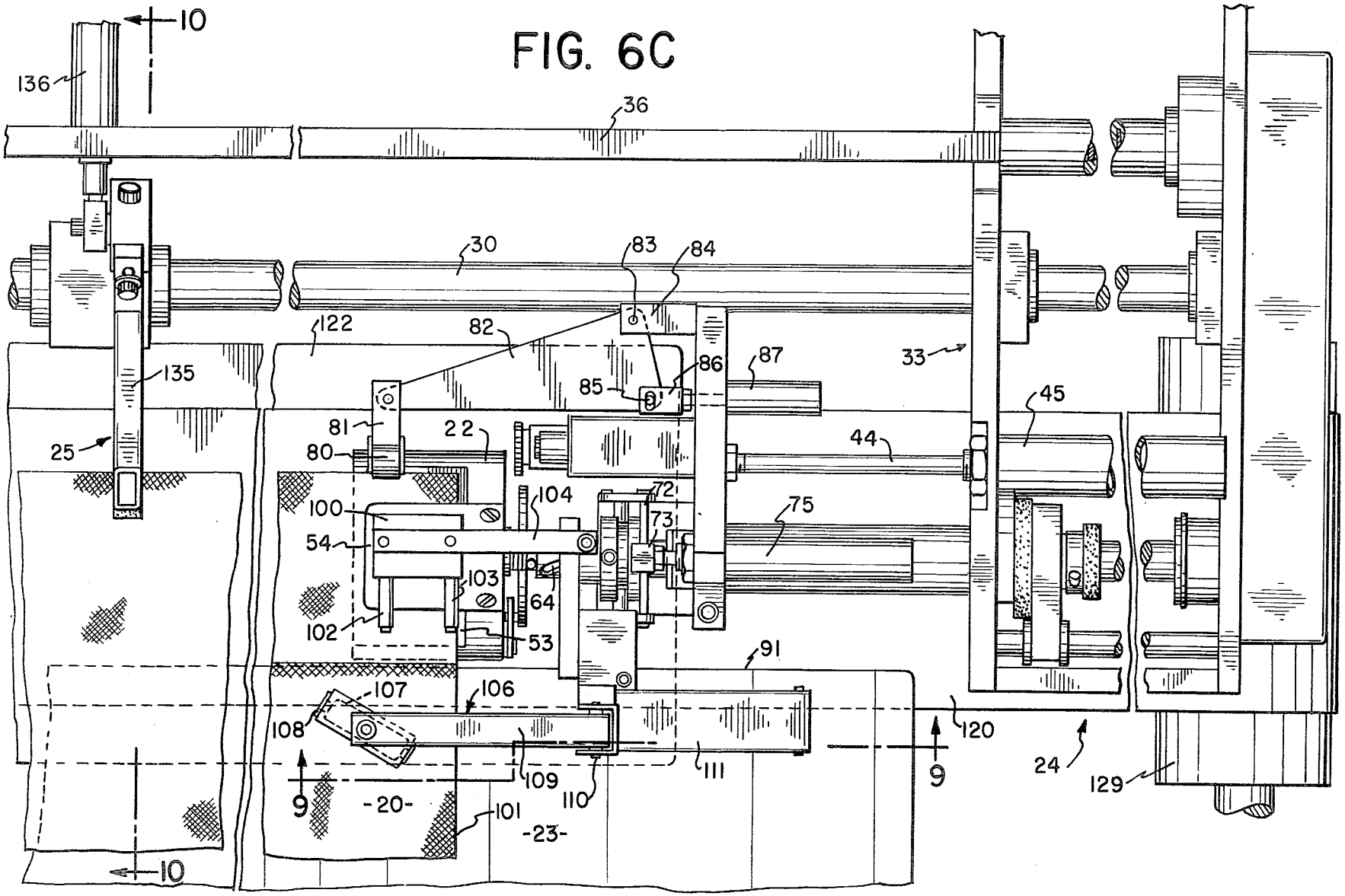
Figure 11:
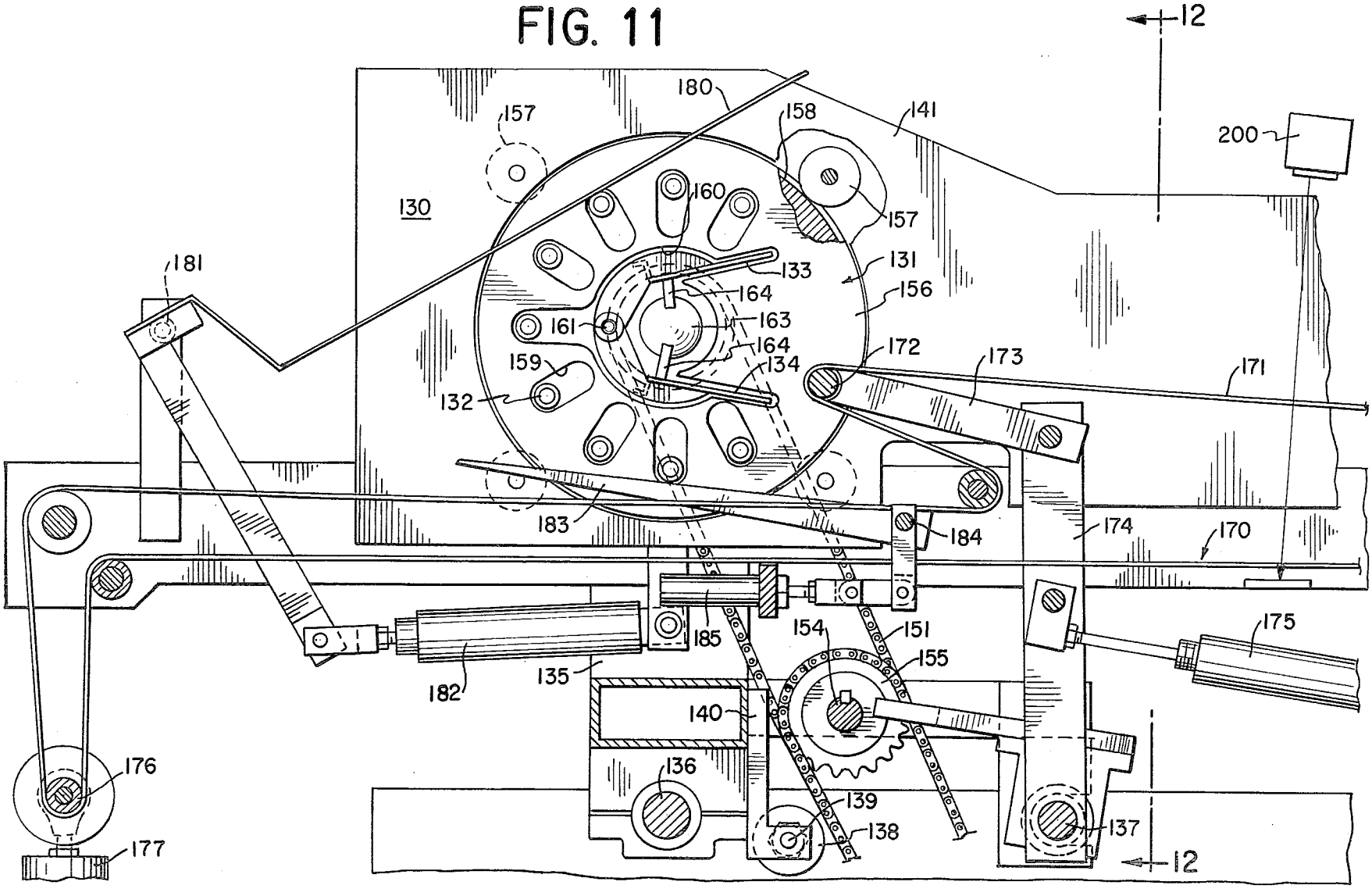
FIG. 11 is an enlarged, fragmentary front elevational view showing details of the second stage winding drum.
Figure 12:
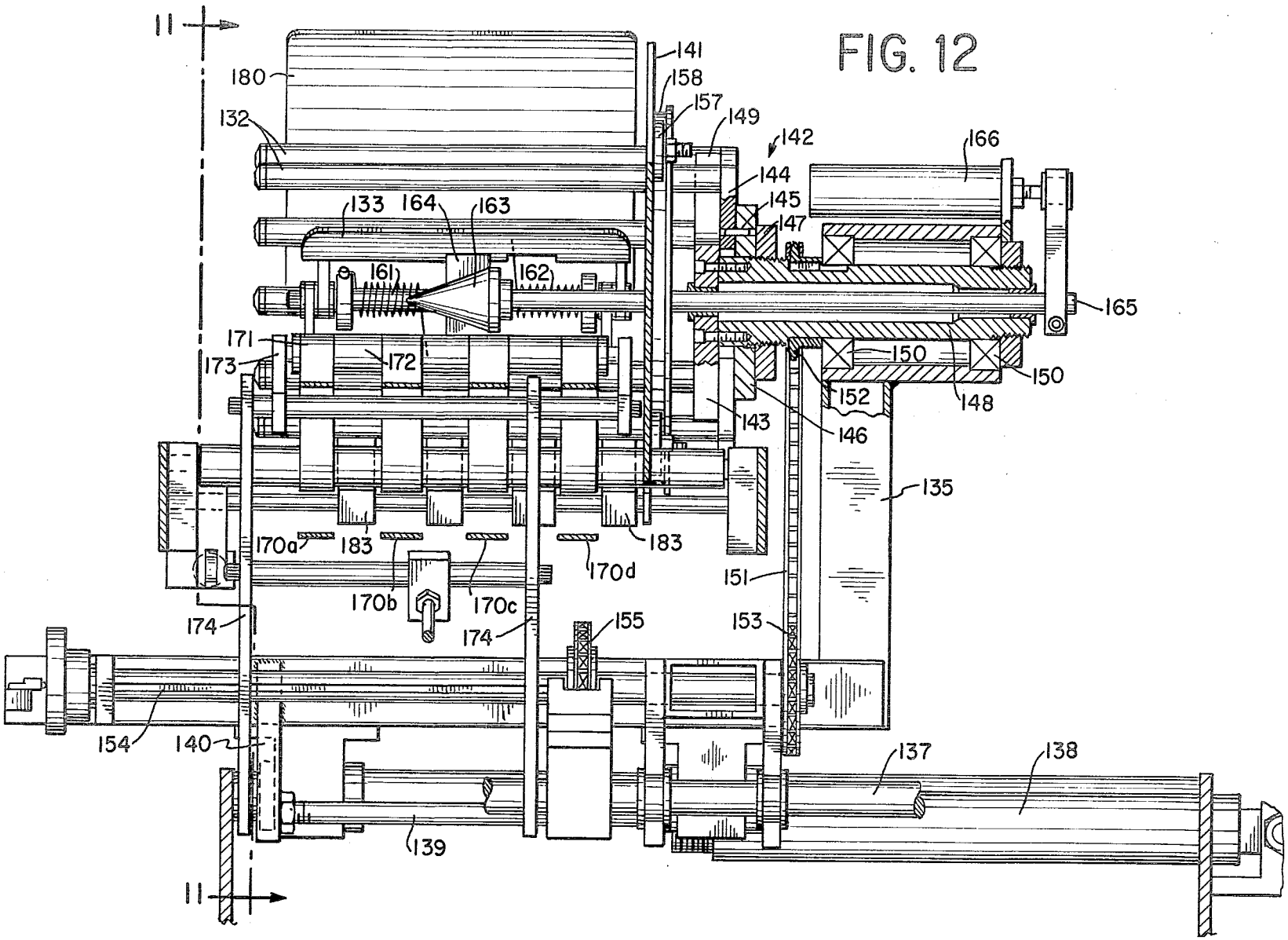
FIG. 12 is a cross sectional view as taken generally on line 12—12 of FIG. 11.

With reference particularly to FIGS. 6*a*, 11 and 12, the second stage winding station 130 includes a winding drum 131 having a plurality of axially retractable support fingers 132 arranged in a generally cylindrical configuration but having an open side in which is located clamping jaws 133, 134. The entire second stage drum assembly is mounted on a carriage 135 supported slideably on guide rods 136, 137. The carriage position is controlled by a fluid actuator 138, the operating rod 139 of which is connected to the carriage by a bracket 140. When the actuator 138 is extended, the carriage 135 is advanced to its operative position. When the actuator is retracted, the carriage is withdrawn, which serves to fully retract the several support fingers 132 and clamping jaws 133, 134 to a position behind a guide wall 141.

The fingers 132 of the winding drum are supported for rotation by a hub structure 142, which includes a radially slotted guide plate 143 receiving the fingers 132 for radial movement. Each of the support fingers is mounted on an arm 144, which is connected by a pin 145 to a rotatable control plate 146. The control plate 146 normally is held in fixed position, tightly clamping the finger supporting arms 144, by means of a threaded collar 147 mounted on the main shaft 148.

Desirably, the effective size of the second stage winding drum 131 may be increased or decreased by moving the fingers 132 radially inward or outward. This is accomplished by first loosening the threaded collar 147 and then controllably rotating the disc 146. Since the disc is pinned individually to the several finger supporting arms 144, while the fingers themselves are retained in radial slots 149 in the plate 143, rotation of the disc 146 will effect radial movement of the fingers, either inward or outward depending on the direction of rotation. The fingers may then be locked in an adjusted position by retightening of the collar 147.

The main drum supporting shaft 148 is mounted for rotation on the carriage 135, by means of spaced bearings 150. The shaft is rotatably driven by means of a chain 151, engaging a sprocket 152 on the shaft 148 and also engaging a drive sprocket 153 fixed to the end of a slotted drive shaft 154. The drive shaft 154, which is carried by and movable with the carriage 135, is slideably keyed to a sprocket 155, appropriately connected to a drive input.

The secondary winding drum 131 includes a circular guide plate 156, which is flush with the main guide wall 142 and is supported and guided for rotational movement therein by means of a plurality of spaced guide rollers 157 received in an annular recess 158 in the circular plate. The circular plate 156 is arranged to rotate along with the support fingers 132, and is provided with radial openings 159 to accommodate adjustment of the fingers. The circular plate 156 also has a central opening 160, for the reception of the clamping jaws 133, 134. The jaws are pivoted on a shaft 161, which is mounted on the slotted plate 143. Springs 162 on the shaft 161 serve to urge the clamping jaws 133, 134 together, into closed relation, and a conical cam 163, engageable with cam follower surfaces 164, functions to urge the clamping jaws in an opening direction.

As reflected particularly in FIG. 12, the cam 163 is carried by an elongated rod 165, which passes through the hollow drum mounting shaft 148 and is connected at its distant end to a fluid actuator 166. When the actuator 166 is extended rearwardly, the conical cam 163 is retracted, permitting the jaws 133 to close.

Figure 4:
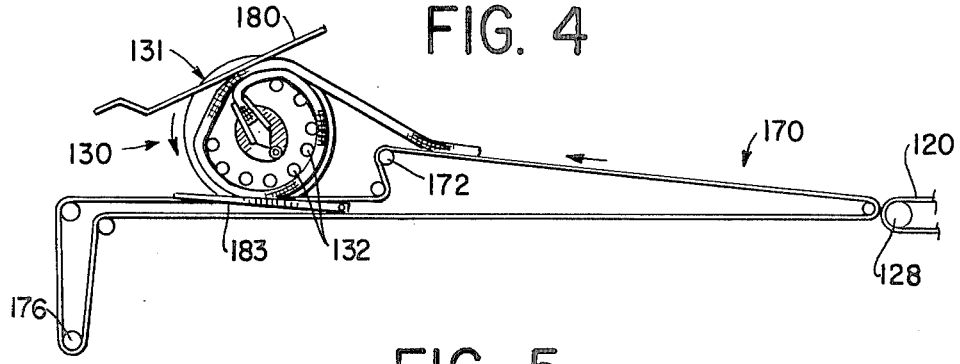

With reference particularly to FIGS. 3, 4 and 11, a once-wound fabric panel 123 is advanced toward the second stage winding drum 131, first by the conveyor 120, and then by a second conveyor 170 positioned adjacent the discharge end of the first mentioned conveyor. In preparation for a loading operation, the second stage winding drum 131 is rotationally oriented such that its open jaws 133, 134 face toward the incoming panel, in position to receive the leading edge thereof. In order to drive the once-wound fabric panel into the open jaws, the conveyor belt 170 has an upwardly inclined infeed portion 171, which is passed over a guide roller 172 positioned in front of the second stage winding drum 131. The guide roller 172 is carried by an extension 173 of a bracket 174, which is pivotally mounted on the shaft 137. The bracket 174 is connected to a fluid actuator 175 such that, when the actuator is extended, as shown in FIG. 11, the guide roller 172 is moved into close proximity with the open clamping jaws 133, 134, somewhat above the lower jaw. Thus, when a once-folded panel is advanced along the upwardly inclined infeed section 171 of the conveyor, the leading end of the fabric is discharged into the open clamping jaws, as shown in FIG. 3. Thereafter, the jaws are closed by retraction of the conical cam 163 in preparation for the second stage wind up.

Advancing and retracting movement of the guide roller 172 changes the configuration of the conveyor belt 170, as is evident in FIGS. 3 and 4. Accordingly, the conveyor system is provided with a tension roller 176, which is guided into a frame for vertical movement and is acted upon by a weight 177.

To accommodate the winding of the panel in the second stage, the guide roller 172 is withdrawn by retraction of the fluid actuator 175, to a position as shown in FIG. 4. Thereafter, the winding drum 131 is rotated, in order to wind the panel in a second direction, as reflected in FIG. 4. During the second stage winding, a light pressure and winding tension is maintained on the fabric in several ways. First, there is some inherent friction resulting from the drag of the fabric as it is drawn off of the conveyor 170. Second, a flattening panel 180, which is pivotally mounted at 181 in the machine frame and is connected to a fluid actuator 182, presses lightly on the outside surface of the winding fabric, as shown in FIG. 4. In addition, a plurality of finger-like support elements 183 are pivoted at 184 in the frame and are urged lightly upward against the winding fabric by means of a fluid actuator 185. The fingers 183 extend between individual, spaced, belt-like elements 170*a*–170*d*, which together constitute the conveyor 170.

Figure 5:
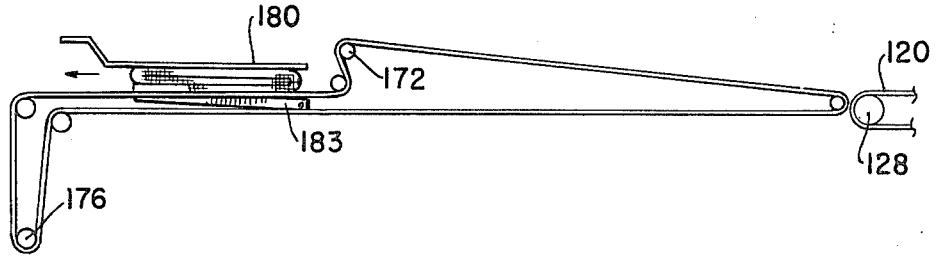
FIG. 5 is a simplified, schematic illustration showing the flattening of a folded panel, after the second stage of folding.

When a second stage winding operation has been completed, the fluid actuator 166 is energized to open the clamping jaws, and the actuator 138 is energized to retract the entire winding drum carriage 135. The wound fabric is, of course, prevented from moving with the support fingers 132, by reason of the presence of the circular plate 156, which strips the fabric off of the fingers. The fabric then drops down onto the conveyor belt 170 and support elements 183. At the same time, the actuator 182 is energized to pivot the flattening panel 180 downward, more or less as shown in FIG. 5 of the drawings, such that the wound fabric is lightly compressed between the panel 180 and the finger-like elements 183. This serves to shape the now twice-wound panel into a neat, flat, rectangular form ready for packaging. The packaging operation, not a part of the present invention, may proceed after release of the twice-wound fabric panel from the flattening element 180 and the finger-like elements 183, permitting the fabric to be conveyed away by the conveyor 170.

To advantage, both the first and second stage winding operations are carried out in a manner to accommodate adjustable, predetermined location of the exposed edges of the fabric panel. In the first stage winding operation, this is effected by stoppage of the winding drums 21, 22 in a predetermined rotary position. As the first stage winding operation nears completion, a photocell or other detector (not shown) senses the trailing end edge of the fabric and initiates a position control function. The control facility, which per se may be conventional, may function by a counting or other system to provide for a predetermined rotational increment of the winding drums, following sensing of the trailing edge, such that the winding drums stop when the trailing edge is located in a predetermined manner. This may be either to conceal the edge or to feature it, depending on the particular desires of the manufacturer. During the second stage winding operation, the passage of the trailing edge of the once-wound panel is detected by a photocell sensor 200 (FIG. 11), which likewise initiates a rotary motion control, providing for a further predetermined rotational increment of the winding drum 131, stopping the drum when the trailing edge reaches a specific, desired position most suitable to the desires of the manufacturer in the finished package.

In some cases, it is advantageous to provide a stiffener in the finished package. Where this is desired, a flexible stiffener may be inserted by the operator at an appropriate point during the second stage winding. The stiffener can conform to the circular contours of the second stage winding drum, during the winding operation, but becomes flat when the wound material is released and dropped onto the conveyor 170.

The method and apparatus of the invention are uniquely advantageous for the winding and packaging of large flat panels of material, such as sheets, bedspreads, curtains, draperies, and the like. Heretofore, such panels have been folded largely in manual operations or with large, expensive and inefficient equipment. With the present apparatus, panels are manually loaded into the first stage winding drums, after which the entire winding operations, both first stage and second stage, are carried out automatically and with substantial precision, to provide a neat, uniform finish-folded product. The uniformity of shape and dimension in the finish-folded product is of particular advantage, because it accommodates subsequent automatic packaging operations. Pursuant to the invention, individual panels, from a supply thereof placed at the front of the machine, are drawn over leading and trailing edges of a flat, bowed plate as the panel is being wound into a cylinder of predetermined dimensions. During the winding operation, the fabric is flattened by the bowed plate, and accurate edge registration of the panel is easily maintained by sensing of the fabric edge as it passes over the plate. After winding in the first stage, the wound fabric is held at the center while the winding drums are withdrawn from each end, permitting the wound panel to drop on to a lateral conveyor, on which the fabric assumes a flat condition. The once-wound fabric is then conveyed laterally into the jaws of a second stage winding drum, which grips the lateral edge of the once-wound fabric and winds it about a different axis, forming a second cylinder. After the second winding operation, the second stage drum is withdrawn, permitting the twice-wound panel to drop upon a conveyor, where it is pressed into flat condition, suitable for packaging.

Both the first stage and second stage winding drums provide for some adjustment of effective diameter for control of the final dimensions of the folded panel.

The method and equipment of the invention are easily adaptable to the many variables which are inherent in the handling of fabrics. Moreover, the equipment required is highly compact. A typical machine for handling panels of up to 1.8 meters in width, can be set up in a floor space of approximately 4.3 meters by 1.2 meters. Extremely high efficiencies can be achieved by utilization of the equipment in pairs, such that a single operator, located between two adjacent machines, assists two other operators in alternately loading the two machines. While the common operator is loading one machine, the other machine can be executing a winding operation, with the operator specifically attending that machine performing inspection and other functions.

It should be understood, of course, that the specific form of the invention herein illustrated and described is intended to be representative only, as certain changes may be made therein without departing from the clear teachings of the disclosure. Accordingly, reference should be made to the following appended claims in determining the full scope of the invention.

We claim:

1. The process of flat folding large panels of limp material, such as fabric, which comprises (a) gripping the panel by opposed corners of its leading edge, (b) winding the panel about first stage forming drums positioned adjacent the sides of the panel and disposed on a common first axis of the panel, (c) axially withdrawing the forming drums from the wound panel and causing or permitting the wound panel to assume a generally flat form, (d) conveying the wound panel laterally to a second stage winding station, (e) engaging the leading lateral edge of the once-wound panel and winding the same about a second stage forming drum along a second axis at right angles to said first axis, (f) maintaining light squeezing pressure on said panel during the second stage winding thereof, (g) withdrawing said second forming drum from the twice-wound panel, and (h) causing the twice-wound panel to assume a generally flattened form by continuing said squeezing pressure after withdrawal of said second stage forming drum.

2. Apparatus for winding a panel of fabric or the like, which comprises (a) a pair of axially spaced first stage winding drums engageable with opposite leading edge corner areas of the panel for effecting a first stage of winding thereof, (b) a lateral conveyor belt for transporting a once-wound panel laterally, (c) said lateral conveyor belt including an elongated laterally disposed conveyor belt underlying said first stage winding drums, (d) support means for said conveyor belt, operative normally to support said belt at a level sufficiently below said first stage winding drums to accommodate lateral passage of a once-wound panel underneath at least one of the drums, (e) controllable means for elevating said conveyor belt during a first stage winding operation to a level closely underlying the winding fabric, (f) a second stage winding drum positioned to receive a lateral edge of the once-wound panel, (g) said drum including panel support means of generally cylindrical outline, (h) at least a portion of said panel support means forming an opening for the generally radial entry of the once-wound panel, (i) clamping jaw means generally within the outline of said drum and aligned with said opening for the engagement of the end of a radially entering panel, and (j) means for axially withdrawing said support means and said jaw means, relative to the panel, after completion of second stage winding.

3. Apparatus for flat folding large panels of limp material, which comprises (a) a pair of axially spaced first stage winding drums mounted for rotation on a common axis, (b) means on said first stage winding drums for engaging opposite leading corner areas of a panel, (c) drive means for controllably rotating said first stage winding drums for winding said panel, (e) lateral conveyor means positioned directly under said first stage winding drums, (f) means for axially withdrawing said first stage winding drums from a once-wound panel to deposit said panel on said lateral conveyor means, (g) a second stage winding drum, disposed at right angles to said first stage winding drums and positioned to receive a once-wound panel being conveyed by said lateral conveyor means, (h) said second stage drum having a plurality of panel supporting elements arranged about its rotational axis and a gripping jaw for engagement with the leading lateral edge of the once-wound panel, (i) means for axially withdrawing said panel supporting element and said gripping jaw from the twice-wound panel, (j) a bowed plate positioned adjacent and generally parallel to said common axis, and having spaced-apart laterally extending edges, (k) means to position said bowed plate such that fabric panels are drawn over and smoothed out by the said spaced-apart edges of said plate as said fabric is advanced toward said first stage winding drums, (l) edge alignment rollers positioned adjacent each end of said bowed plate for selective engagement with a side edge margin of a fabric panel, (m) said rollers being disposed at an acute angle with respect to the side edges of the panel, whereby when a roller is brought into pressure contact with a moving fabric panel, the panel is shifted laterally in the direction of said roller, (n) sensing means for continuously sensing the edge of the fabric on at least one side, and (o) means for selectively and alternatively bringing one or the other or neither but not both of said edge alignment rollers into pressure contact with the fabric in accordance with the sensed position of the fabric edge.

4. Apparatus for performing a second stage of winding upon a once-wound and flattened panel of fabric or the like, which comprises (a) lateral conveyor belt for transporting a once-wound panel laterally,
(b) a second stage winding drum positioned to receive a lateral edge of the once-wound panel,
(c) said drum including panel support means of generally cylindrical outline,
(d) at least a portion of said panel support means forming an opening for the generally radial entry of the once-wound panel,
(e) clamping jaw means generally within the outline of said drum and aligned with said opening for the engagement of the end of a radially entering panel,
(f) means for axially withdrawing said support means and said jaw means, relative to the panel, after completion of second stage winding,
(g) said conveyor belt including an (i) infeed portion extending to an area near said opening, (ii) a support portion extending underneath said drum, and (iii) a transitional portion extending from said infeed portion to said support portion,
(h) guide roll means for guiding and supporting said conveyor belt,
(i) said guide roll means being movable toward and into close proximity to the clamping jaw means during infeeding of a once-wound panel, and being movable away from said jaw means during winding of the panel on said drum,
(j) said guide roll means defining the end of said infeed portion and the beginning of said transitional portion of said conveyor belt.

5. Apparatus for flat folding large panels of limp material, which comprises
(a) a pair of axially spaced first stage winding drums mounted for rotation on a common axis,
(b) means on said first stage winding drums for engaging opposite leading corner areas of a panel,
(c) drive means for controllably rotating said first stage winding drums for winding said panel,
(e) lateral conveyor means positioned directly under said first stage winding drums,
(f) means for axially withdrawing said first stage winding drums from a once-wound panel to deposit said panel on said lateral conveyor means,
(g) a second stage winding drum, disposed at right angles to said first stage winding drums and positioned to receive a once-wound panel being conveyed by said lateral conveyor means,
(h) said second stage drum having a plurality of panel supporting elements arranged about its rotational axis and a gripping jaw for engagement with the leading lateral edge of the once-wound panel,
(i) a rotatable supporting shaft for said second stage winding drum,
(j) a hub plate mounted on said supporting shaft,
(k) said plurality of panel supporting elements comprising finger-like elements arranged in a generally cylindrical array,
(l) said gripping jaw being positioned in a space between certain of said finger-like elements, and
(m) means for axially withdrawing said supporting shaft to withdraw said finger-like elements and said jaw from a twice-wound panel.

6. Apparatus according to claim 5, further characterized by said lateral conveyor means comprising
(a) conveyor means passing generally underneath said second stage winding drum, and
(b) guide roll means for diverting an infeed portion of said conveyor means upward with respect to said second stage winding drum whereby to direct a once-wound panel toward said gripping jaw.

7. Apparatus according to claim 6, further characterized by
(a) said guide roll means including a guide roller mounted for controlled displacement toward and away from said second stage winding drum, and
(b) means for displacing said guide roller toward and into close proximity with said second stage winding drum during the advancement of a once-wound panel laterally toward and into said gripping jaw.

* * * * *